US005379007A

United States Patent [19]

Nakahara

[11] Patent Number: 5,379,007

[45] Date of Patent: Jan. 3, 1995

[54] REFLECTION PHASE SHIFTER AND MULTIPLE BIT PHASE SHIFTER

[75] Inventor: Kazuhiko Nakahara, Itami, Japan

[73] Assignee: Mitsubishi Denki Kabushiki Kaisha, Tokyo, Japan

[21] Appl. No.: 148,612

[22] Filed: Nov. 8, 1993

[30] Foreign Application Priority Data

May 31, 1993 [JP] Japan ..... 5-128620

[51] Int. Cl.[5] ..... H01P 1/18

[52] U.S. Cl. ..... 333/156; 333/164

[58] Field of Search ..... 333/109, 117, 156, 161, 333/164, 103, 104, 138, 140, 139

[56] References Cited

U.S. PATENT DOCUMENTS

| | | | |
|---|---|---|---|
| 4,612,520 | 9/1986 | Boire et al. | 333/164 X |
| 4,789,846 | 12/1988 | Matsunaga et al. | 333/104 |
| 4,810,911 | 3/1989 | Noguchi | 307/571 |
| 5,128,639 | 7/1992 | Ueda et al. | 333/164 |

FOREIGN PATENT DOCUMENTS

| | | | |
|---|---|---|---|
| 0165202 | 6/1989 | Japan | 333/164 |
| 378301 | 4/1991 | Japan . | |
| 398301 | 4/1991 | Japan . | |
| 3244201 | 10/1991 | Japan . | |

OTHER PUBLICATIONS

Opp et al., "Design of Digital Loaded-Line Phase-Shift Networks for Microwave Thin-Film Applications," IEEE, 1968, pp. 180-186.

Boire et al., "4:1 Bandwidth Digital Five Bit MMIC Phase Shifters," IEEE, 1988, pp. 69-73.

*Primary Examiner*—Seungsook Ham

*Attorney, Agent, or Firm*—Leydig, Voit & Mayer

[57] ABSTRACT

A reflection phase shifter includes a 3 dB directional coupler having opposite first and second ends, a reflection circuit connected between the first and second ends of the 3 dB directional coupler, a first resonant circuit connected between a node connecting the first end of the 3 dB directional coupler and the reflection circuit and ground, and a second resonant circuit connected between a node connecting the second end of the 3 dB directional coupler and the reflection circuit and ground. Each resonant circuit comprises an FET and an inductor connected between source and drain electrodes of the FET. In this reflection phase shifter, when the resonant circuits are open, the first and second ends of the 3 dB directional coupler are connected to the reflection circuit. On other hand, when the resonant circuits are short-circuited, the first and second ends of the 3 dB directional coupler are grounded. As a result, three different phases, i.e., two different phase shift quantities, are attained in one reflection phase shifter.

6 Claims, 9 Drawing Sheets

REFLECTION PHASE SHIFTER AND MULTIPLE BIT PHASE SHIFTER

FIELD OF THE INVENTION

The present invention relates to a reflection phase shifter and a multiple bit phase shifter that can reduce chip size.

BACKGROUND OF THE INVENTION

FIG. 11 is a circuit diagram illustrating a structure of a conventional three bit phase shifter, In the figure, three bit phase shifter 900 includes three reflection phase shifters 900*a* to 900*c* providing different phase shift quantities from each other. The reflection phase shifters 900*a* to 900*c* are connected in series between an input terminal 1 and an output terminal 2.

The reflection phase shifter 900*a* comprises a 3 dB directional coupler 3 and a reflection circuit 90 interposed between opposite ends of the 3 dB directional coupler 3. The reflection circuit 90 includes two FETs 4*a* and 4*b* whose sources are grounded and whose drains are connected through transmission lines 6*a* and 6*b* to the respective ends of the 3 dB directional coupler 3. Reference numerals 5*a* and 5*b* designate gate bias terminals of the FETs 4*a* and 4*b*, respectively.

Since the reflection phase shifters 900*b* and 900*c* are identical to the reflection phase shifter 900*a*, only blocks are illustrated for the reflection phase shifters 900*b* and 900*c* in FIG. 11 for simplification.

A description is given of the operation.

Initially, the operating principle of a reflection phase shifter in which a reflection ($\Gamma_T$) is connected between opposite ends of an ideal 3 dB directional coupler is described.

Characteristics of the reflection phase shifter are represented in an S matrix as follows:

$$\begin{pmatrix} b1 \\ b2 \\ b3 \\ b4 \end{pmatrix} = \begin{pmatrix} 0 & f1 & 0 & f2 \\ f1 & 0 & f2 & 0 \\ 0 & f2 & 0 & f1 \\ f2 & 0 & f1 & 0 \end{pmatrix} \begin{pmatrix} a1 \\ \Gamma_T b2 \\ 0 \\ \Gamma_T b4 \end{pmatrix} \quad (1)$$

where a1 is an input power and b1 to b4 are reflected Dowers of the input power to the respective ends of the 3 dB directional coupler.

In addition, f1 and f2 in the equation (1) are operating characteristics of the ideal 3 dB directional coupler and represented as follows:

$$f1 = \frac{jk \sin\theta}{\sqrt{1-k^2}\cos\theta + j\sin\theta} \quad (2)$$

$$f2 = \frac{\sqrt{1-k^2}}{\sqrt{1-k^2}\cos\theta + j\sin\theta} \quad (3)$$

wherein Θ is the electrical length of the 3 dB directional coupler and k is the coupling coefficient of the 3 dB directional coupler.

The equation (1) is converted to $$b1 = f1\Gamma_T b2 + f2\Gamma_T b4 \quad (4)$$

$$b2 = f1 a1 \quad (5)$$

$$b3 = f2\Gamma_T b2 + f1\Gamma_T b4 \quad (6)$$

$$b4 = f2 a1 \quad (7)$$

From these equations (4) to (7), following S parameters are obtained.

$$S11 = S22 = b1/a1 = f1^2\Gamma_T \quad (8)$$

$$S21 = S12 = b3/a1 = 2f1f2\Gamma_T \quad (9)$$

Since the 3 dB directional coupler is an ideal one, the coupling coefficient k is $1/\sqrt{2}$ and the electrical length Θ is 90°. Accordingly, $$f1 = 1\sqrt{2} \quad (10)$$

$$f2 = j \cdot -1/\sqrt{2} \quad (11)$$

When the equations (10) and (11) are combined, the equation (9) is converted to $$S21 = S12 = 2f1f2\Gamma_T = -k\Gamma_T \quad (12)$$

From the equation (12), it is found that the phase shift quantity of the reflection phase shifter including the ideal 3 dB directional coupler is determined by the reflection ($\Gamma_T$) connected between the opposite ends of the 3 dB directional coupler.

FIG. 12(*a*) illustrates a part of the reflection circuit 90 included in the reflection phase shifter 900*a* shown in FIG. 11. In the figure, reference numeral 4 designates an FET, numeral 5 designates a gate bias terminal of the FET 4, numeral 6 designates a transmission line, and numeral 7 designates a connecting terminal. FIGS. 12(*b*) and 12(*c*) illustrate the reflection circuit of FIG. 12(*a*) during the switching operation of the FET 4. In FIG. 12(*b*), the FET 4 is in the ON state. In FIG. 12(*c*), the FET 4 is in the OFF state.

In the reflection circuit of FIG. 12(*a*), the reflection viewed from the input side, i.e., the impedance $Z_T$ of the circuit is represented as $$Z_T = R_T + jX_T = Z_L\left(\frac{Z_{FET} + jZ_L \tan\theta_L}{Z_L + jZ_{FET}\tan\theta_L}\right) \quad (13)$$

where $R_T$ is the resistance of the whole circuit, $X_T$ is the reactance of the whole circuit, $Z_L$ is the impedance of the distributed constant line 6, $Z_{FET}$ is the impedance of the FET 4, and $\Theta_L$ is the electrical length of the distributed constant line 6.

The impedances of the FET 4 in the ON and OFF states are respectively represented by the following equations (14) and (15).

$$Z_{FET}\text{-ON} = R_{ON} = 0 \quad (14)$$

$$Z_{FET}\text{-OFF} = 1/j\omega C \quad (15)$$

When the equations (14) and (15) are combined with the equation (13), the following equations (16) and (17) are obtained.

$$Zf = jZ_L \tan\theta_L = jXf \quad (16)$$

-continued $$Z_r = jZ_L\left(\frac{-1/\omega C + Z_L \tan\theta_L}{Z_L + 1/\omega C \cdot \tan\theta_L}\right) = jXr \quad (17)$$

where Zf and Xf are the impedance and the reactance of the reflection circuit, respectively, when the FET is in the ON state, and Zr and Xr are the impedance and the reactance of the reflection circuit, respectively, when the FET is in the OFF state. Since the equations (16) and (17) comprise imaginary components only, the reflection $\Gamma_T$ is represented as follows:

$$\Gamma_T = \frac{jX_T - 1}{jX_T + 1} = \frac{X_T^2 - 1}{1 + X_T^2} - j\frac{2X_T}{1 + X_T^2} \quad (18)$$

Assuming that $$|\Gamma_T| = 1 \quad (19)$$

and $$\Gamma_T = |\Gamma_T| exp(j\phi'/2) \quad (20)$$

($\phi'/2$: phase component of $\Gamma_T$)

the equation (18) is simplified to $$tan(\phi'/2) = 2X_T/1 - X_T^2 \quad (21)$$

The reactance $X_T$ of the equation (21) becomes $\tan(\phi'/4)$ according to the following formula of double angle trigonometric functions (22), $$\tan 2\theta = \frac{2\tan\theta}{1 - \tan^2\theta} \quad (22)$$

and, therefore, it is found that the phase shift quantity is doubled by the reflection.

From the equations (12), (18), and (20), the following equation (23) is attained.

$$S21 = -j\Gamma_T = \frac{-2X_T}{1 + X_T^2} + j\frac{X_T^2 - 1}{1 + X_T^2} \quad (23)$$

Assuming that $$|S21| = 1 \quad (24)$$

and $$S21 = |S21| exp(j\phi/2)$$

($\phi/2$: phase component) (25)

the phase $\angle S21$ of the reflection phase shifter where the reflection of the reflection circuit is $\Gamma_T$ is represented by $$\angle S21 = \tan(\phi/2) = \frac{-1}{\tan(\phi'/2)} = \tan\left(\frac{\pi}{2} - \frac{\phi}{2}\right) \quad (26)$$

If a reflection phase shifter having a phase shift quantity $\Delta\phi$ is designed, the relation between the reflection Ff of the reflection circuit in the FET-ON state and the reflection Fr of the reflection circuit in the FET-OFF state is set as shown in the phase diagram of FIG. 13.

Accordingly, from the equations (16) and (17), the following equations (27) and (28) are attained.

$$Xf = Z_L \tan\theta_L = \tan\left(\frac{\pi}{2} - \frac{\phi}{4}\right) \quad (27)$$

$$Xr = Z_L \frac{-1/\omega C + Z_L \tan\theta_L}{Z_L + 1/\omega C \cdot \tan\theta_L} = -Xf \quad (28)$$

From the equations (27) and (28), element parameters of the reflection circuit shown in FIG. 9 are obtained.

As described above, since the conventional reflection phase shifter provides only one phase shift quantity, as many reflection phase shifters as desired phase shift quantities must be connected in series to make a multiple bit phase shifter, increasing the chip size of the multiple bit phase shifter.

In such a multiple bit phase shifter, an input signal is transmitted through a plurality of the reflection phase shifters connected in series, so that the transmission ..Loss of the signal is unfavorably increased.

SUMMARY OF THE INVENTION

An object of the present invention is to provide a reflection phase shifter providing a plurality of different phase shift quantities.

Another object of the present invention is to provide a multiple bit phase shifter including a reflection phase shifter which is smaller than the conventional multiple bit phase shifter.

Still another object of the present invention is to provide a multiple bit phase shifter including reflection phase shifter which has less signal transmission loss than that of the conventional multiple bit phase shifter.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to a first aspect of the present invention, a reflection phase shifter includes a 3 dB directional coupler having opposite first and second ends, a reflection circuit connected between the first and second ends of the 3 dB directional coupler, a first resonance circuit connected between a node connecting the first end of the 3 dB directional coupler and the reflection circuit and ground, and a second resonance circuit connected between a node connecting the second end of the 3 dB directional coupler and the reflection circuit and ground. Each resonance circuit comprises an FET and an inductor connected between source and drain electrodes of the FET. In this reflection phase shifter, when the resonance circuits are open, the first and second ends of the 3 dB directional coupler are connected to the reflection circuit. On the other hand, when the resonance circuits are short-circuited, the first and second ends of the 3 dB directional coupler are grounded. As a result, three different phases are attained in one reflection phase shifter.

According to a second aspect of the present invention, a reflection phase shifter includes a 3 dB directional coupler having opposite first and second ends, a reflection circuit disposed between the first and second ends of the 3 dB directional coupler, a first resonance circuit interposed between the first end of the directional coupler and the reflection circuit, and a second resonance circuit interposed between the second end of the directional coupler and the reflection circuit. Each resonance circuit comprises an FET and an inductor connected between source and drain electrodes of the FET. In this reflection phase shifter, when the resonance circuits are open, the first and second ends of the 3 dB directional coupler are connected to the reflection circuit. On the other hands when the resonance circuits are short-circuited, the first and second ends of the 3 dB directional coupler are open. As a result, three different phases are attained in one reflection phase shifter.

According to a third aspect of the present invention, a two bit phase shifter comprises an input side SPDT (Single Pole Double Throw) switch, an output side SPDT switch, a first 3 dB directional coupler having open or grounded opposite ends connected between the input side and the output side SPDT switches, and a reflection phase shifter connected between the input side and the output side SPDT switches in parallel with the first 3 dB directional coupler. The reflection phase shifter comprises a second 3 dB directional coupler having opposite first and second ends and two FETs. Source electrodes of the FETs are grounded and drain electrodes of the FETs are respectively connected to the first and second ends of the second 3 dB directional coupler via transmission lines. By controlling the input side and the output side SPDT switches, an input signal is transmitted through one of the reflection phase shifter and the first 3 dB directional coupler. In this way, three different phases, i.e., two different phase shift quantities, are attained by only switching the signal transmission path. Since the input signal is transmitted through only one reflection phase shifter, the signal transmission loss is significantly decreased compared to the conventional two bit phase shifter in which two reflection phase shifters having different phase shift quantities are connected in series.

According to a fourth aspect of the present invention, a three bit phase shifter comprises an input side SPDT switch, an output side SPDT switch, and two reflection phase shifters connected in parallel with each other between the input side and the output side SPDT switches. Each reflection phase shifter comprises a 3 dB directional coupler having opposite first and second ends and two FETs. Source electrodes of the FETs are grounded and drain electrodes of the FETs are respectively connected to the first and second ends of the 3 dB directional coupler via transmission lines. By controlling the input side and the output side SPDT switches, an input signal is transmitted through one of the reflection phase shifters having different phase shift quantities. In this way, four different phases, i.e., three different phase shift quantities, are attained only by switching the signal transmission path. Since the input signal is transmitted through only one reflection phase shifter, the signal transmission loss is significantly decreased compared to the conventional three bit phase shifter in which three reflection phase shifters having different phase shift quantities are connected in series. In addition, since two reflection phase shifters provide three different phase shift quantities, the chip size is reduced compared to the conventional three bit phase shifter.

BRIEF DESCRIPTION OF THE PREFERRED EMBODIMENTS

DETAILED DESCRIPTION OF THE PREFERRED EMBODIMENTS

Figure 1:
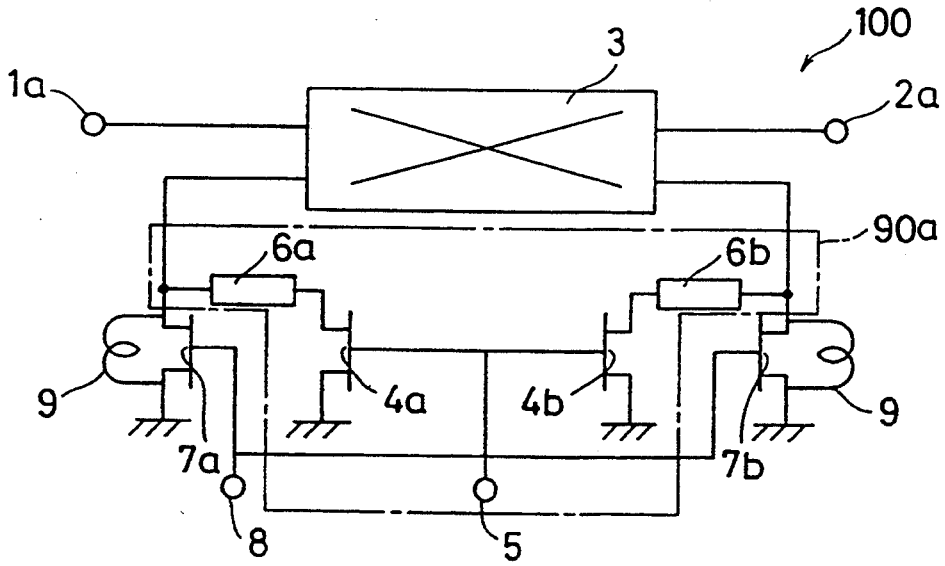
FIG. 1 is a circuit diagram illustrating a reflection phase shifter in accordance with a first embodiment of the present invention.

FIG. 1 is a circuit diagram illustrating a reflection phase shifter in accordance with a first embodiment of the present invention. In the figure, the same reference numerals as in FIG. 11 designate the same or corresponding parts. The reflection phase shifter 100 according to this first embodiment comprises a 3 dB directional coupler 3, a reflection circuit 90*a*, and source-grounded FETs 7*a* and 7*b*. The 3 dB directional coupler 3 is interposed between an input terminal la and an output terminal 2a. The reflection circuit 90*a* is interposed between opposite first and second ends of the 3 dB directional coupler 3. Drains of the FETs 7*a* and 7*b* are connected to the first and second ends of the 3 dB directional coupler 3, respectively. A inductor 9 is connected between the source and the drain of FETs 7*a* and 7*b*. The structure of the reflection circuit 90*a* is fundamentally identical to the reflection circuit 90 of the conventional reflection phase shifter 900*a* shown in FIG. 11 except that a gate bias terminal 5 is commonly connected to the FETs 4*a* and 4*b*. Reference numeral 8 designates a gate bias terminal common to the FETs 7*a* and 7*b*.

Each of the source-grounded FETs 7*a* and 7*b* having the inductor 9 between the source and the drain is a resonance circuit which resonates at the center frequency in the employed frequency band. When the resonance circuits are open, i.e., when the FETs 7a and 7b are in the OFF state, the opposite first and second ends of the 3 dB directional coupler 3 are respectively connected to the transmission lines 6a and 6b of the reflection circuit 90a. On the other hand, when the resonance circuits are short-circuited, i.e., when the FETs 7a and 7b are in the ON state, the first and second ends of the 3 dB directional coupler 3 are grounded.

Figure 2:
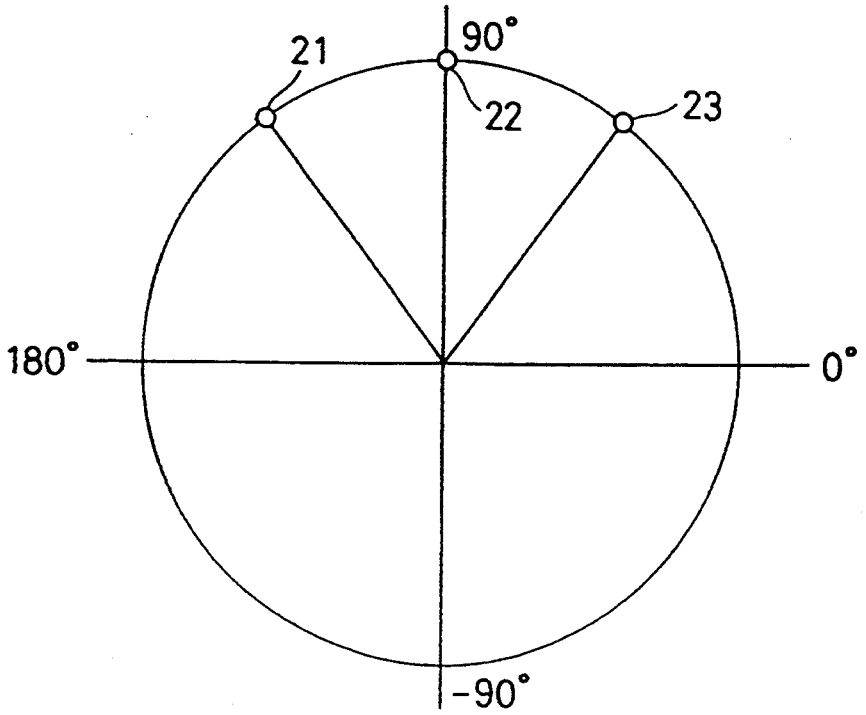
FIG. 2 is a diagram illustrating different phases attained in the reflection phase shifter of FIG. 1.

A description is given of operation. When the FETs 7a and 7b are in the OFF state, the first and second ends of the 3 dB directional coupler 3 are connected to the reflection circuit 90a. Since the structure of the reflection circuit 90a is identical to the reflection circuit 90 shown in FIG. 11, the reflection phase shifter 100 operates in the same way as the conventional reflection phase shifter 900a shown in FIG. 11. On the other hand, when the FETs 7a and 7b are in the ON state, the first and second ends of the 3 dB directional coupler 3 are grounded. In this case, since the reactance $X_T$ of the whole circuit is zero in the above-described equation (18), the reflection $\Gamma_T$ is $-1$. Therefore, the equation $S21=-j\Gamma_T$ is reduced to $S21=j$, and the phase $\angle S21$ of the reflection phase shifter is 90°. Accordingly, if the phase shift achieved by the reflection circuit 90a is $\phi$, the reflection phase shifter 100 provides three different phases, i.e., $90°+\phi/2°$, 90°, and $90°+\phi/2°$ respectively indicated by reference numerals 21, 22, and 23 in FIG. 2.

In the reflection phase shifter 100 according to the first embodiment of the present invention, the FETs 7a and 7b each having the inductor 9 connected between the source and the drain are switches for selecting one of the two states, i.e., a state where the opposite first and second ends of the 3 dB directional coupler 3 are connected to the reflection circuit 90a and a state where these ends are grounded, whereby three different phases are attained. Therefore, two different phase shift quantities are attained in one reflection phase shifter 100, resulting in a two bit phase shifter smaller than the conventional two bit phase shifter in which two reflection phase shifters are connected in series.

Figure 3:
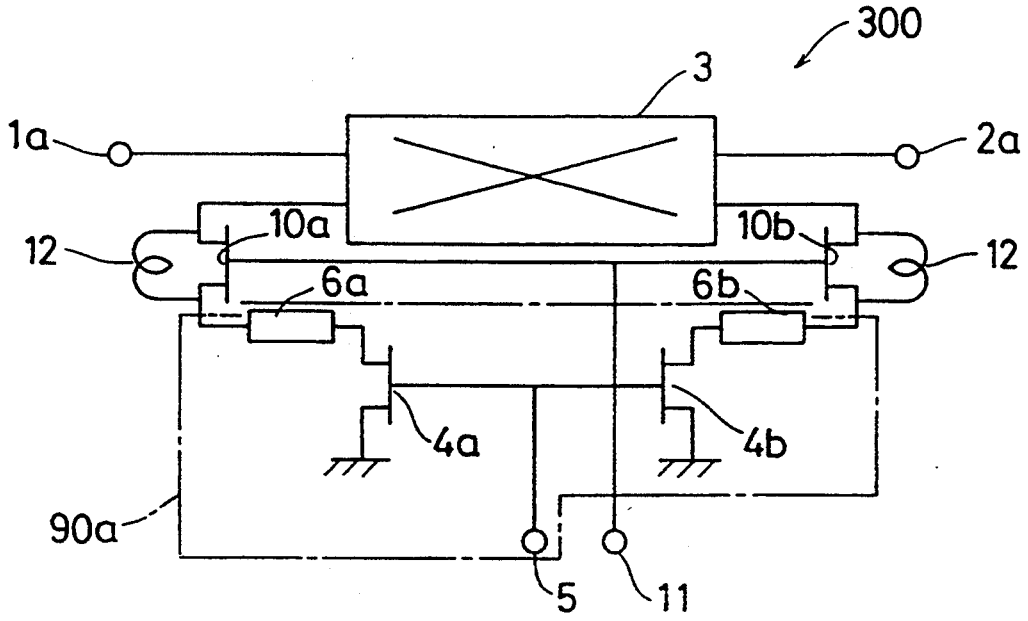
FIG. 3 is a circuit diagram illustrating a reflection phase shifter in accordance with a second embodiment of the present invention.

FIG. 3 is a circuit diagram illustrating a reflection phase shifter in accordance with a second embodiment of the present invention. In the figure, the same reference numerals as in FIG. 1 designate the same or corresponding parts. A reflection phase shifter 300 according to the second embodiment comprises a 3 dB directional coupler 3, FETs 10a and 10b, and a reflection circuit 90a. The 3 dB directional coupler 3 is interposed between an input terminal la and an output terminal 2a. Drains of the FETs 10a and 10b are respectively connected to opposite first and second ends of the 3 dB directional coupler 3. Sources of these FETs are connected to the reflection circuit 90a. A resonant inductor 12 is connected between the source and the drain of each FET. Reference numeral 11 designates a gate bias terminal common to the FETs 10a and 10b.

Each of the FETs 10a and 10b having the inductor 12 connected between the source and the drain is a resonance circuit which resonates at the center frequency in the employed frequency band. When these resonance circuits are open, i.e., when the FETs 10a and 10b are in the OFF state, the first and second ends of the 3 dB directional coupler 3 are open. On the other hand, when the resonance circuits are short-circuited, i.e., when the FETs 10a and 10b are in the ON state, the first and second ends of the 3 dB directional coupler 3 are connected to the reflection circuit 90a.

A description is given of operation.

Figure 4:
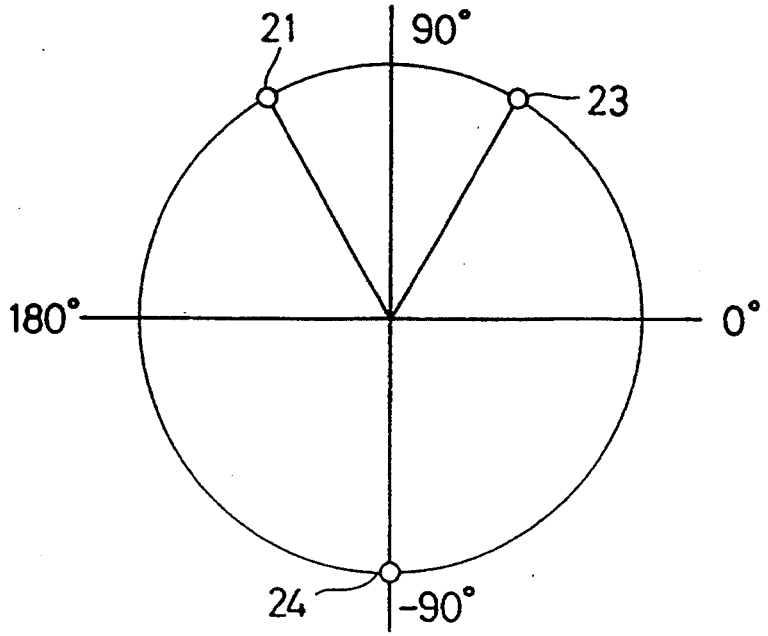
FIG. 4 is a diagram illustrating different phases attained in the reflection phase shifter of FIG. 3.
Figure 11:
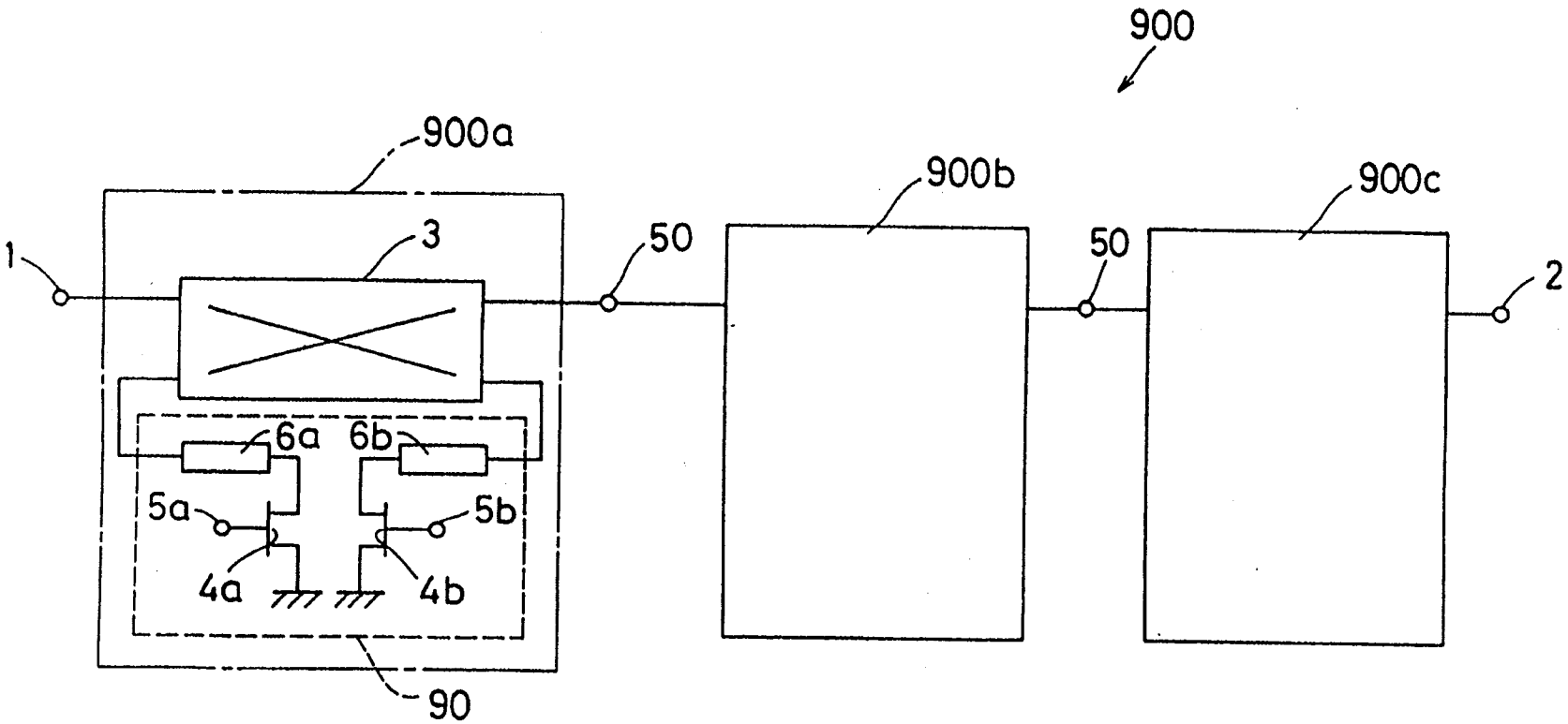
Fig.11 (Prior Art)
FIG. 11 is a circuit diagram illustrating a multiple bit phase shifter in accordance With the prior art.
Figure 12:
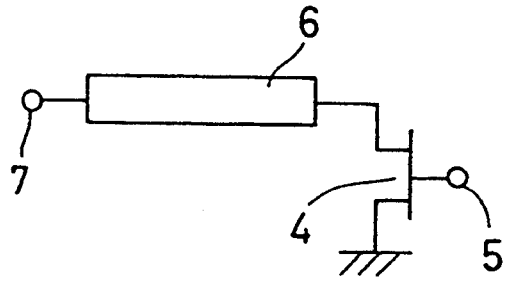
FIG. 12(*a*) is a circuit diagram illustrating a part of a reflection circuit included in the reflection phase shifter of FIG. 11 and FIGS. 12(*b*) and 12(*c*) illustrate the reflection circuit during the switching operation of an FET included in the reflection circuit.
Figure 12:
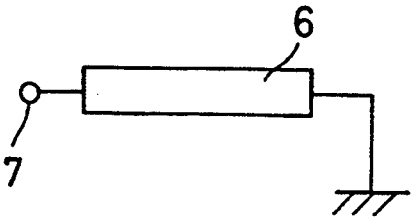
Figure 12:
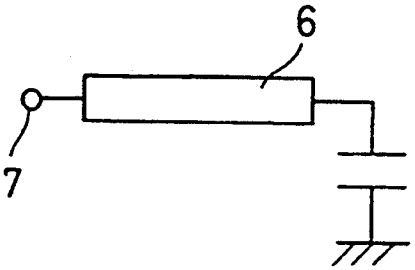
Figure 13:
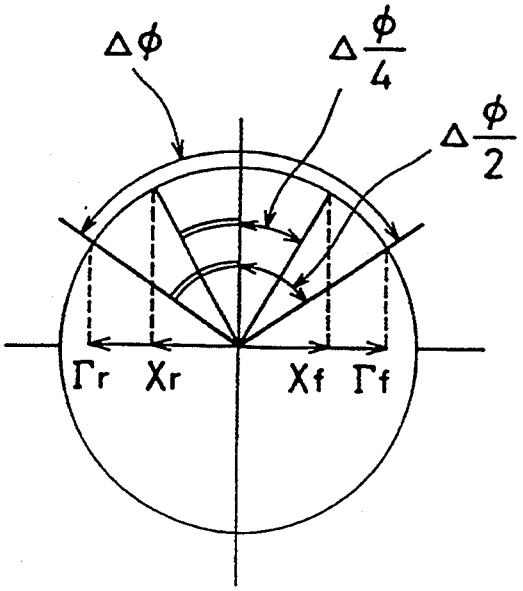
Fig.13 (Prior Art)
FIG. 13 is a diagram illustrating the phase state of the reflection circuit included in the reflection phase shifter of FIG. 11.

When the FETs 10a and 10b are in the ON state, the first and second ends of the 3 dB directional coupler 3 are connected to the reflection circuit 90a, and the reflection phase shifter 300 operates in the same way as the conventional reflection phase shifter 900a shown in figure 11. On the other hand, when the FETs 10a and 10b are in the OFF state, the first and second ends of the 3 dB directional coupler 3 are open. In this case, since the reactance of the whole circuit $X_T$ is infinite ($\infty$) in the above-described equation (18), the reflection $\Gamma_T$ is $-1$. Therefore, the equation $S21=-j\Gamma_T$ is reduced to $S21=-j$, and the phase $\angle S21$ of the reflection phase shifter is $-90°$. Accordingly, if the phase shift quantity achieved by the reflection circuit 90a is $\phi$, the reflection phase shifter 300 provides three different phases, i.e., $90°+\phi/2°$, $90°-\phi/2°$, and $-90°$ respectively indicated by reference numerals 21, 23, and 24 in FIG. 4.

In the reflection phase shifter 300 according to the second embodiment of the present invention, the FETs 10a and 10b each having the inductor 12 connected between the source and the drain are switches for selecting one of the two states, i.e., a state where the first and second ends of the 3 dB directional coupler 3 are connected to the reflection circuit 90a and a state where these ends are open, whereby three different phases are attained. Therefore, two different phase shift quantities are attained in one reflection phase shifter, resulting in a two bit phase shifter smaller than the conventional two bit phase shifter including two reflection phase shifters connected in series.

Figure 5:
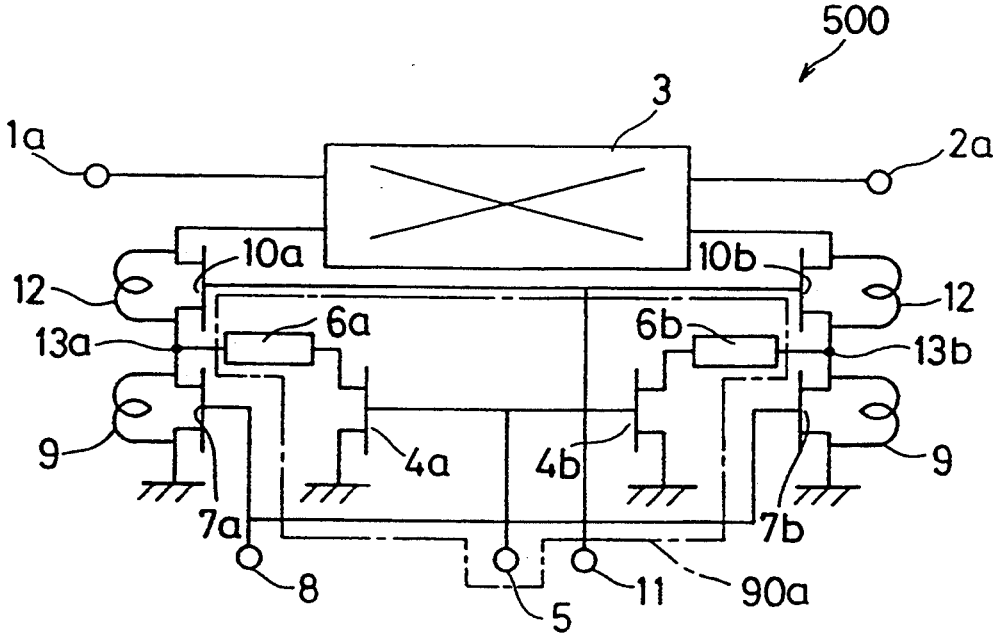
FIG. 5 is a circuit diagram illustrating a reflection phase shifter in accordance with a third embodiment of the present invention.
Figure 6:
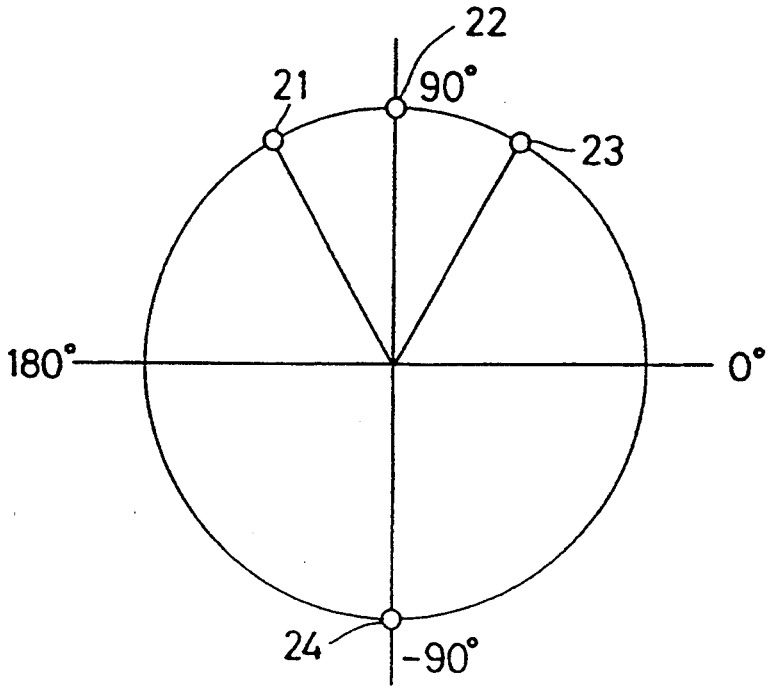
FIG. 6 is a diagram illustrating different phases attained in the reflection phase shifter of FIG. 5.

FIG. 5 is a circuit diagram illustrating a reflection phase shifter in accordance with a third embodiment of the present invention. In the figure, the same reference numerals as in FIGS. 1 and 3 designate the same or corresponding parts. In the reflection phase shifter 500 of this third embodiment, the reflection phase shifter 100 of FIG. 1 and the reflection phase shifter 300 of FIG. 3 are combined. More specifically, the FETs 10a and 10b, each having the inductor 12 connected between the source and the gate and making a resonance circuit, are interposed between the respective ends of the 3 dB directional coupler 3 and the reflection circuit 90a. Reference numerals 13a and 13b designate nodes connecting the FETs 10a and 10b to the reflection circuit 90a, respectively. The FETs 7a and 7b, each having the inductor 9 connected between the source and the drain and making a resonance circuit, are interposed between the respective nodes 13a and 13b and ground.

In this reflection phase shifter 500, the FETs 7a, 7b, 10a, and 10b are switches for selecting one of three states, i.e., a state where the opposite first and second ends of the 3 dB directional coupler 3 are connected to the reflection circuit 90a, a state where these ends are open, and a state where these ends are grounded. That is, the operations of the reflection phase shifters 100 and 300 shown in FIGS. 1 and 3, respectively, are combined. Therefore, the reflection phase shifter 500 provides four different phases, i.e., $90°+\phi/2°$, $+90°$, $90°-\phi/2°$, and $-90°$ respectively indicated by reference numerals 21, 22, 23, and 24 in FIG. 21, so that three different phase shift quantities are attained in one reflection phase shifter, resulting in a three bit phase shifter smaller than the conventional three bit phase shifter including three reflection phase shifters connected in series.

Figure 7:
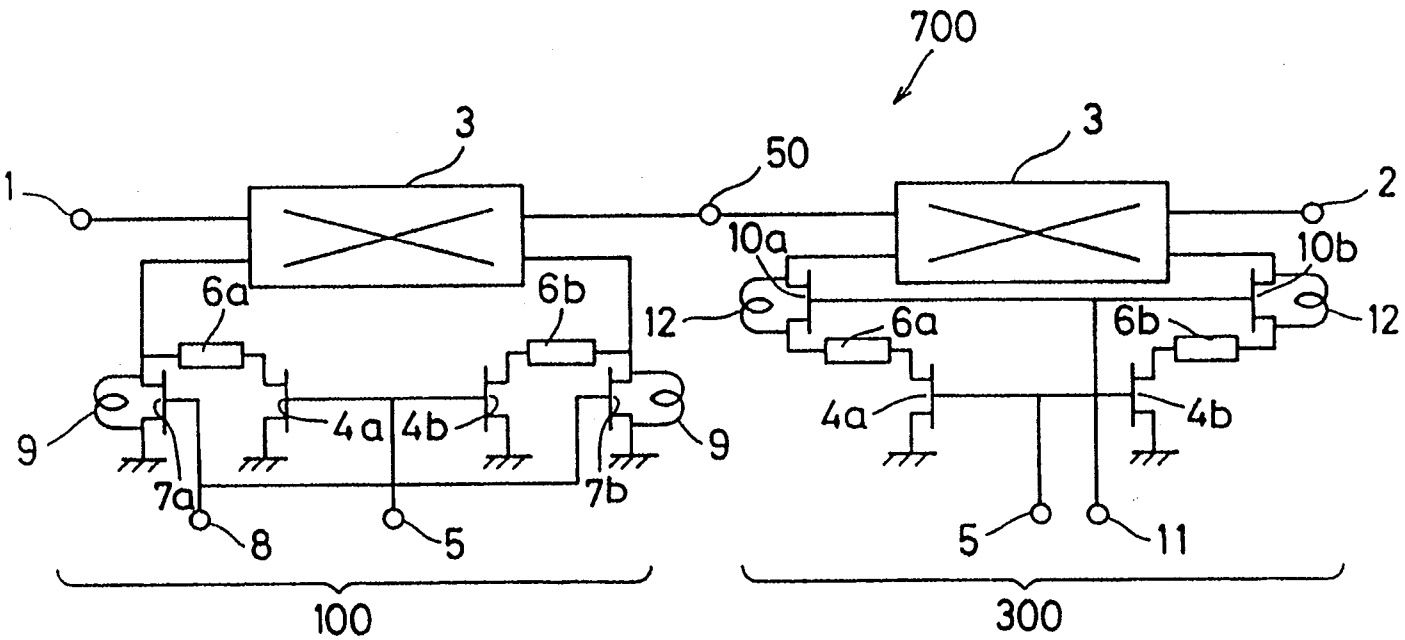
FIG. 7 is a circuit diagram illustrating a multiple bit phase shifter in accordance with a fourth embodiment of the present invention.

FIG. 7 is a circuit diagram illustrating a three bit phase shifter in accordance with a fourth embodiment of the present invention. In the figure, the same reference numerals as in FIGS. 1, 3, and 11 designate the same or corresponding parts. The three bit phase shifter 700 of this fourth embodiment comprises the reflection phase shifter 100 of the first embodiment and the reflection phase shifter 300 of the second embodiment which are connected in series. Reference numeral 50*a* designates a terminal connecting the reflection phase shifters 100 and 300.

In the three bit phase shifter 700, if the phase shift quantity achieved by the reflection circuit 90*a* comprising the transmission lines 6*a* and 6*b* and the FETs 4*a* and 4*b* is set at 90°, the reflection phase shifter 100 provides two phase shift quantities of 90° and 225° and the reflection phase shifter 300 provides two phase shift quantities of 90° and 225°, so that the whole phase shifter 700 provides three phase shift quantities of 180°, 90°, and 45°. In this fourth embodiment, since the three bit phase shifter 700 is achieved with the two reflection phase shifters 100 and 300, the chip size of the three bit phase shifter 700 is reduced compared to the conventional three bit phase shifter including three reflection phase shifters connected in series.

Figure 8:
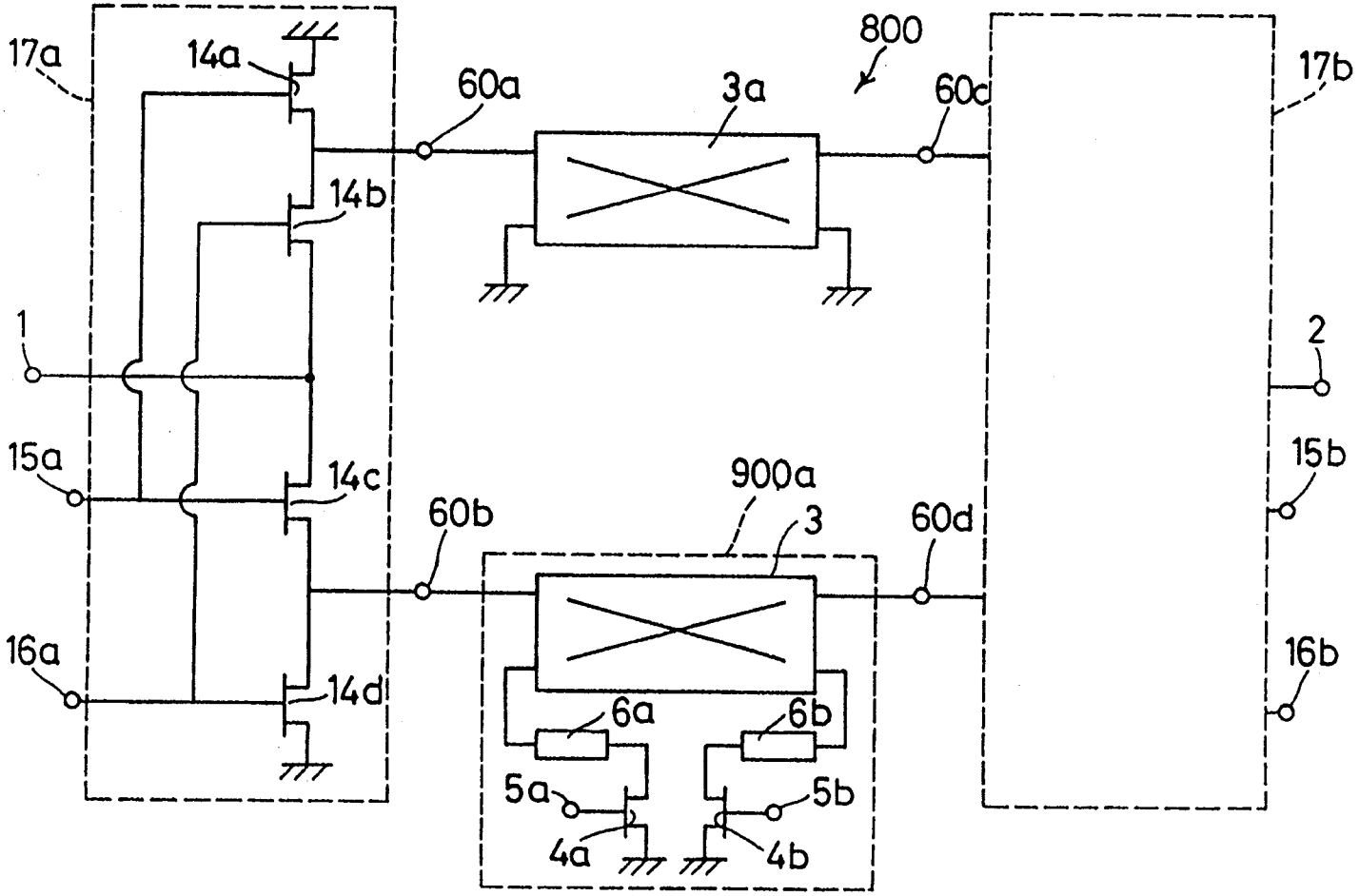
FIG. 8 is a circuit diagram illustrating a multiple bit phase shifter in accordance with a fifth embodiment of the present invention.

FIG. 8 is a circuit diagram illustrating a two bit phase shifter in accordance with a fifth embodiment of the present invention. In the figure, the same reference numerals as in FIG. 11 designate the same or corresponding parts. The two bit phase shifter 800 of this fifth embodiment comprises a 3 dB directional coupler 3*a*, an input side single pole double throw switch (hereinafter referred to as SPDT switch) 17*a*, an output side SPDT switch 17*b*, and a reflection circuit 900*a* which is identical to the conventional reflection circuit shown in FIG. 11. The 3 dB directional coupler 3*a* is interposed between a first output terminal 60*a* of the input side SPDT switch 17*a* and a first input terminal 60*c* of the output side SPDT switch 17*b*, and opposite first and second ends of the 3 dB directional coupler 3*a* are grounded. The reflection phase shifter 900*a* is interposed between a second output terminal 60*b* of the input side SPDT switch 17*a* and a second input terminal 60*d* of the output side SPDT switch 17*b*.

In the input side SPDT switch 17*a*, a pair of FETs 14*a* and 14*b* connected in series between an input terminal 1 and ground are connected in parallel to another pair of FETs 14*c* and 14*d* that are connected in series between the input terminal 1 and ground. In addition, gates of the FETs 14*a* and 14*c* are connected to a first switching control terminal 15*a* and gates of the FETs 14*b* and 14*d* are connected to a second switching control terminal 15*b*.

In FIG. 8, the output side SPDT switch 17*b* is identical to the input side SPDT switch 17*a* and, therefore, only a block is illustrated for the output side SPDT switch 17*b*. Reference numeral 2 designates an output terminal. Reference numerals 15*b* and 16*b* designate switching control terminals.

In this two bit phase shifter 800, the 3 dB directional coupler 3*a* with the grounded first and second ends provides one phase and the reflection phase shifter 900*a* provides two different phases. The input side and the output side SPDT switches 17*a* and 17*b* switch the signal transmission path between the first signal transmission path through the 3 dB directional coupler 3*a* and the second signal transmission path through the reflection phase shifter 900*a*. Therefore, the whole phase shifter 800 provides three different phases, i.e., two different phase shift quantities. In the conventional two bit phase shifter, since two reflection phase shifters having different phase shift quantities are connected in series, the signal transmission loss is increased. In the two bit phase shifter 800 of this embodiment, however, since signals are transmitted through only one reflection phase shifter, the signal transmission loss is significantly reduced compared to the conventional phase shifter.

Figure 9:
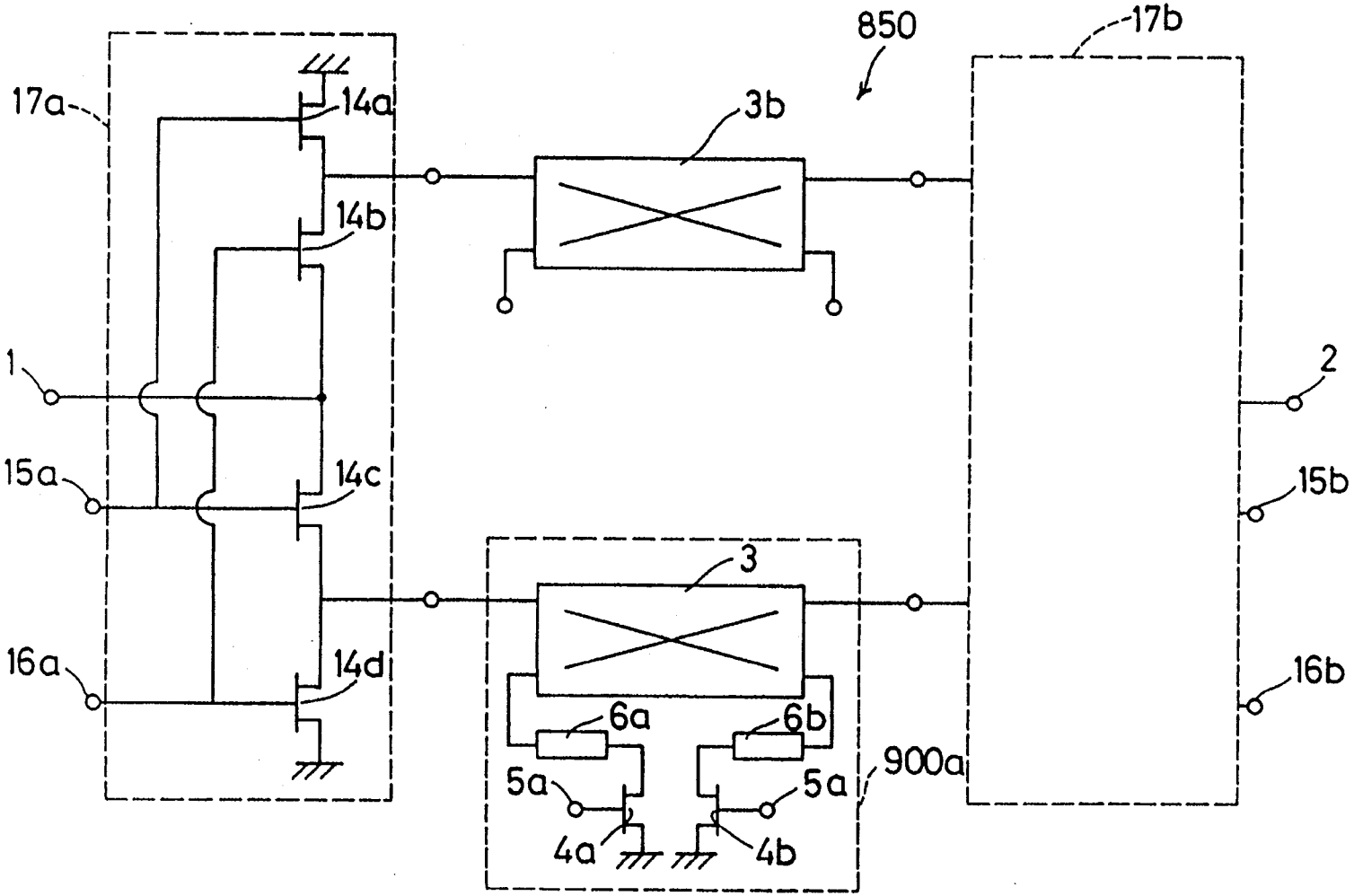
FIG. 9 is a circuit diagram illustrating a multiple bit phase shifter in accordance with a sixth embodiment of the present invention.

FIG. 9 is a circuit diagram illustrating a two bit phase shifter in accordance with a sixth embodiment of the present invention. In the figure, the same reference numerals as in FIG. 8 designate the same or corresponding parts. The two bit phase shifter 850 of this sixth embodiment is identical to the two bit phase shifter 800 of FIG. 8 except that the opposite first and second ends of the 3 dB directional coupler 3*b* are open.

In this two bit phase shifter 850, a signal transmission path is selected from the first signal transmission path through the 3 dB directional coupler 3*b* and the second signal transmission path through the reflection phase shifter 900*a* by controlling the input side and the output side SPDT switches 17*a* and 17*b*. Also in this case, three different phases, i.e., two different phase shift quantities, are obtained in the phase shifter 850. In the conventional two bit phase shifter, since two reflection phase shifters having different phase shift quantities are connected in series, the signal transmission loss is increased. In the two bit phase shifter 850 of this embodiment, however, since signals are transmitted through only one reflection phase shifter, the signal transmission loss is significantly reduced compared to the conventional phase shifter.

Figure 10:
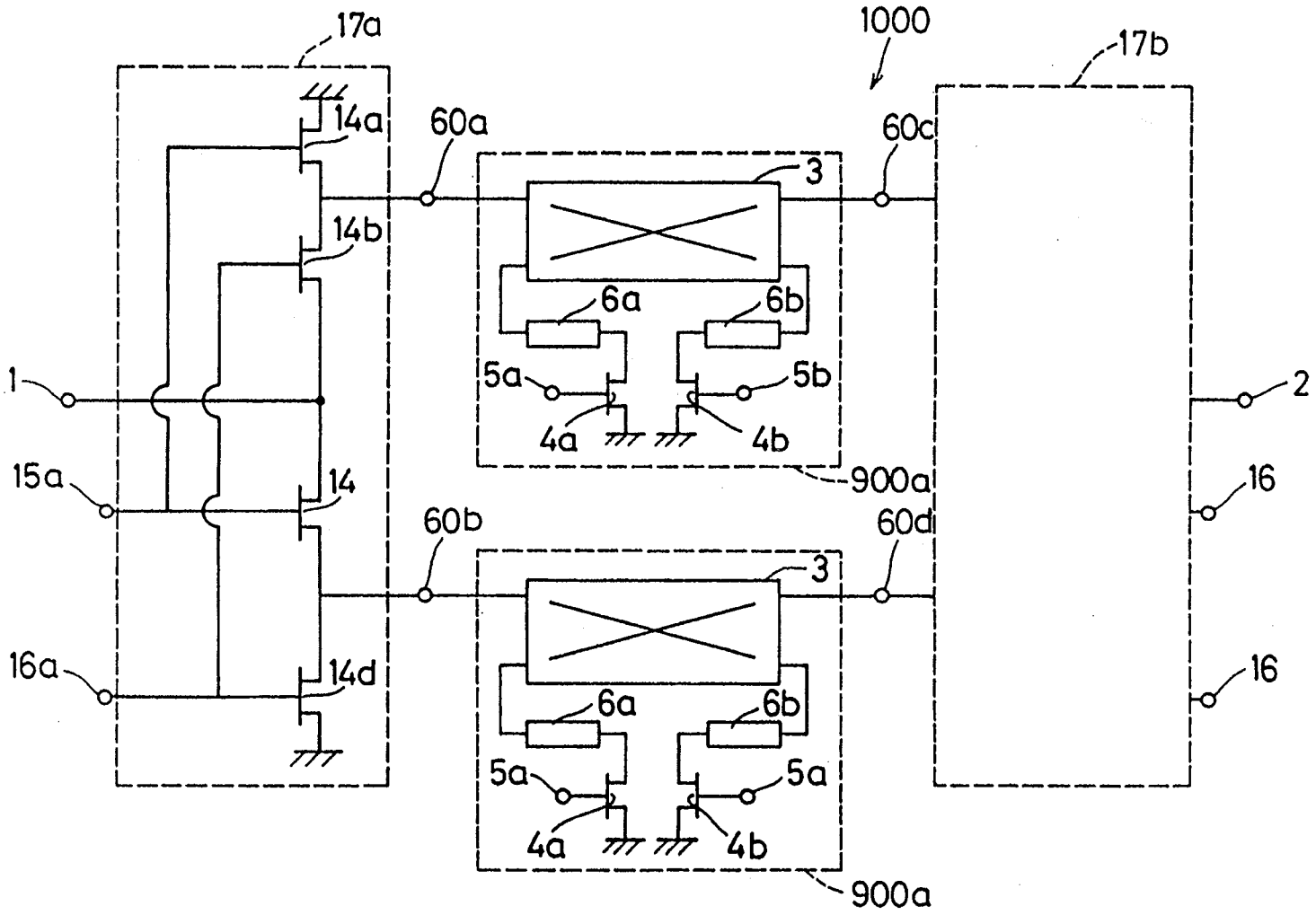
FIG. 10 is a circuit diagram illustrating a multiple bit phase shifter in accordance with a seventh embodiment of the present invention.

FIG. 10 is a circuit diagram illustrating a three bit phase shifter in accordance with a seventh embodiment of the present invention. In this seventh embodiment, the three bit phase shifter 1000 includes a reflection phase shifter 900$a_1$, which is identical to the conventional reflection phase shifter 900*a* shown in FIG. 11, in place of the 3 dB directional coupler 3*a* of the two bit phase shifter 800 shown in FIG. 8. Other parts are the same as those of the two bit phase shifter 800.

In this three bit phase shifter 1000, the phase of one of the two reflection phase shifters 900*a* and 900$a_1$ is set at $\phi 1$ and the phase of the other reflection phase shifter is set at $\phi 2$, and a signal transmission path is selected from the first signal transmission path through the reflection phase shifter 900*a* and the second signal transmission path through the reflection phase shifter 900$a_1$ by controlling the input side and the output side SPDT switches 17*a* and 17*b*, whereby four different phases, $90+\phi\frac{1}{2}$, $90+\phi 2/2$, $90-\phi\frac{1}{2}$, and $90-\phi 2/2$, are attained. In the conventional three bit phase shifter, since three reflection phase shifters having different phase shift quantities are connected in series, the signal transmission loss is increased. In the three bit phase shifter 1000 of this embodiment, however, since signals are transmitted through only one reflection phase shifter, the signal transmission loss is significantly reduced compared to the conventional phase shifter. In addition, since the three bit phase shifter 1000 includes only two reflection phase shifters, the chip size of the three bit phase shifter 1000 is reduced compared to the conventional three bit phase shifter.

What is claimed is:

1. A reflection phase shifter comprising:

a 3 dB directional coupler having first and second ends;

a reflection circuit having first and second ends connected to the first and second ends of said 3 dB directional coupler, respectively;

a first resonant circuit comprising a first field effect transistor (FET) and a first resonant inductor connected between source and drain electrodes of said first FET, the drain electrode of said first FET being connected to a node connecting the first end of said 3 dB directional coupler and the first end of said reflection circuit, the source electrode of said first FET being grounded; and a second resonant circuit comprising a second FET and a second resonant inductor connected between source and drain electrodes of said second FET, the drain electrode of said second FET being connected to a node connecting the second end of the 3 dB directional coupler and the second end of said reflection circuit, the source electrode of said second FET being grounded.

2. The reflection phase shifter of claim 1 wherein said reflection circuit comprises:

first and second transmission lines, each of said first and second transmission lines having first and second ends, the first ends of said first and second transmission lines being respectively connected to the first and second ends of said 3 dB directional coupler; and third and fourth FETs, drain electrodes of said third and fourth FETs being connected to the second ends of said first and second transmission lines, respectively, and source electrodes of said third and fourth FETs being grounded.

3. A reflection phase shifter comprising:

a 3 dB directional coupler having first and second ends;

a reflection circuit having first and second ends;

a first resonant circuit comprising a first field effect transistor (FET) and a first resonant inductor connected between source and drain electrodes of said first FET, said first resonant circuit being connected to the first end of said 3 dB directional coupler and the first end of said reflection circuit; and a second resonant circuit comprising a second FET and a second resonant inductor connected between source and drain electrodes of said second FET, said second resonant circuit being connected to the second end of said 3 dB directional coupler and the second end of said reflection circuit.

4. The reflection phase shifter of claim 3 wherein said reflection circuit comprises:

first and second transmission lines, each of said first and second transmission lines having first and second ends, the first ends of said first and second transmission lines being respectively connected to the first and second ends of said 3 dB directional coupler; and third and fourth FETs, drain electrodes of said third and fourth FETs being connected to the second ends of said first and second transmission lines, respectively, and source electrodes of said third and fourth FETs being grounded.

5. A reflection phase shifter comprising:

a 3 dB directional coupler having first and second ends;

a reflection circuit having first and second ends;

a first resonant circuit comprising a first field effect transistor (FET) and a first resonant inductor connected between source and drain electrodes of said first FET, said first resonant circuit being connected to the first end of said 3 dB directional coupler and the first end of said reflection circuit;

a second resonant circuit comprising a second FET and a second resonant inductor connected between source and drain electrodes of said second FET, said second resonant circuit being connected to the second end of said 3 dB directional coupler and the second end of said reflection circuit;

a third resonant circuit comprising a third FET and a third resonant inductor connected between source and drain electrodes of said third FET, said third resonant circuit being connected to the first end of said reflection circuit and ground; and a fourth resonant circuit comprising a fourth FET and a fourth resonant inductor connected between source and drain electrodes of said fourth FET, said fourth resonant circuit being connected to the second end of said reflection circuit and ground.

6. The reflection phase shifter of claim 5 wherein said reflection circuit comprises:

first and second transmission lines, each of said first and second transmission lines having first and second ends, the first ends of said first and second transmission lines being respectively connected to a first node connecting said first and third FETs and a second node connecting said second and fourth FETs; and fifth and sixth FETs, drain electrodes of said fifth and sixth FETs being connected to the second ends of said first and second transmission lines, respectively, and source electrodes of said fifth and sixth FETs being grounded.

* * * * *